US011568840B2

(12) United States Patent
Emmeiji et al.

(10) Patent No.: US 11,568,840 B2
(45) Date of Patent: Jan. 31, 2023

(54) MULTI TONE CYMBAL

(71) Applicants: Yuuki Emmeiji, Osaka-fu (JP); Michael B. Daugherty, North Garden, VA (US)

(72) Inventors: Yuuki Emmeiji, Osaka-fu (JP); Michael B. Daugherty, North Garden, VA (US)

( * ) Notice: Subject to any disclaimer, the term of this patent is extended or adjusted under 35 U.S.C. 154(b) by 0 days.

(21) Appl. No.: 17/556,036

(22) Filed: Dec. 20, 2021

(65) Prior Publication Data

US 2022/0199055 A1 Jun. 23, 2022

Related U.S. Application Data

(60) Provisional application No. 63/130,129, filed on Dec. 23, 2020.

(51) Int. Cl.

| | |
|---|---|
| ***G10D 13/08*** | (2020.01) |
| ***G10D 13/24*** | (2020.01) |
| ***G10D 13/063*** | (2020.01) |

(52) U.S. Cl.
CPC ..... *G10D 13/08* (2013.01); *G10D 13/063* (2020.02); *G10D 13/24* (2020.02)

(58) Field of Classification Search
CPC ..... G10D 13/08; G10D 13/24; G10D 13/063
See application file for complete search history.

(56) References Cited

U.S. PATENT DOCUMENTS

| | | | | |
|---|---|---|---|---|
| 1,763,518 | A * | 6/1930 | Haweis | G10D 13/08 84/408 |
| 3,673,909 | A * | 7/1972 | Birnkrant | G10D 13/08 84/404 |
| 4,111,094 | A * | 9/1978 | Broser | G10D 13/08 84/411 R |
| 4,137,815 | A * | 2/1979 | Kloc | G10D 13/08 984/151 |
| 4,515,062 | A * | 5/1985 | Bozung | G10D 13/08 984/155 |
| 4,807,510 | A * | 2/1989 | Croteau | G10D 13/063 984/154 |
| 4,955,276 | A * | 9/1990 | Feldman | G10D 13/08 984/155 |
| 6,162,976 | A * | 12/2000 | Clausen | G10D 13/08 84/180 |
| 6,376,757 | B1 * | 4/2002 | Clausen | A47C 9/08 84/102 |
| 7,199,297 | B2 * | 4/2007 | Anderson | G10D 13/24 84/422.3 |
| D616,017 | S * | 5/2010 | Partridge, Jr. | D17/22 |
| 7,750,218 | B2 * | 7/2010 | Stannard | G10D 13/06 84/411 R |
| 8,093,477 | B1 * | 1/2012 | Twyford | G10D 13/08 84/411 R |

(Continued)

*Primary Examiner* — Robert W Horn
(74) *Attorney, Agent, or Firm* — Antonio Papageorgiou

(57) ABSTRACT

Multi tonal cymbals are provided having a metallic structure, the structure having a plurality of radial cuts therein defining a plurality of segments, each of the plurality of segments providing a tone different than another of the plurality of segments. The different tone may be achieved with radial cuts having different dimensions and/or placed on different locations on the cymbal to create different shaped/sized segments.

20 Claims, 7 Drawing Sheets

(56) References Cited

U.S. PATENT DOCUMENTS

| | | | | |
|---|---|---|---|---|
| 8,492,632 | B1 * | 7/2013 | Doe | G10D 13/08<br>84/406 |
| 9,576,563 | B2 * | 2/2017 | Güngör | G10D 13/08 |
| 10,559,288 | B2 * | 2/2020 | Sargeant | G10D 13/08 |
| 10,621,960 | B2 * | 4/2020 | Hubbert | G10D 13/08 |
| 2008/0105102 | A1 * | 5/2008 | Stannard | G10D 13/06<br>84/402 |
| 2022/0199055 | A1 * | 6/2022 | Emmeiji | G10D 13/063 |

* cited by examiner

MULTI TONE CYMBAL

BACKGROUND

The present application relates to musical instruments and more particularly percussion instruments.

Modern cymbals evolved from the ancient Turkish style cymbal. These cymbals have one main sound characteristic that may be altered by either varying the diameter, general shape, weight, the production method of the cymbal i.e., hammering, spin forming or spin casting, etc., or the intensity of the musicians' striking of the cymbal or by striking the cymbal in different areas. The end result or effect is that one cymbal has a limited range of tonal frequencies when the cymbal is struck with a drumstick, mallet or by hand. Percussionists therefore must use multiple cymbals each with different characteristics to achieve a broader range of tonal frequencies.

Accordingly, there is a need for percussion instruments that are not so limited.

SUMMARY OF THE INVENTION

The present application provides cymbals that overcome the limitations of prior cymbals. In this regard, the present application provides a multi tone cymbal(s) that represents a novel modification and an improvement over the current standard modern cymbal in its ability to allow for the creation of multiple pitches in one cymbal beyond that of limited-pitched standard cymbals. The pitch or frequencies of the multi toned cymbal can range from actual tuned musical notes, or random and non-scalar notes depending on how it is tuned, both by design and/or during manufacturing of the multi toned cymbal. In this regard, the multi toned cymbals disclosed herein are new musical instrument(s).

In at least one embodiment, a cymbal is provided that is a single disc of the following bell bronze alloys: B8, B15, B20, B21, B23, and/or B25. Each containing a greater ratio of tin to copper metallic elements as the number increases. By way of example, and without limitation, B20 contains 20% tin and 80% copper, B23 contains 23% tin and 77% copper. The ratio of tin is what is denoted in the use of the letter "B" and the number refers to the percentage of tin in the alloy. Any of these alloy ratios could be used for the manufacturing of the multi tone cymbals disclosed herein. The alloys impart different tonal qualities to the cymbal. The use of different alloys is a common and established practice in the cymbal industry and applies to the function and manufacturing of the multi tone cymbal. The multi tone cymbal is distinguishable from, and improves upon, the standard, single toned/pitch cymbal by allowing multiple pitches in one cymbal. The multi pitch cymbal as disclosed herein can be fabricated from any of the above-mentioned cymbal bronze alloys.

The multi tone cymbal may use the industry standard of Turkish cymbal design, either with or without a bell or cup, as shown in the accompanying diagrams. The major difference is the use of various sized and/or shaped segmentations within the disc or cymbal that, in turn, creates multiple pitches, tones, or notes absent from standard single toned/pitch cymbals.

Segmentation may be achieved by creating radial separations (e.g., through cuts in the cymbal), as in the radial division of a circle. These divisions radiate from the approximate center A or at the edge of the bell B outwards towards the edge of the cymbal C, as shown in the accompanying figures, thus creating individual sections that can be tuned as desired, and independent from other individual sections. Each radial division or cut may be terminated with a hole, preferably circular, to relieve stress created by the cut and to prevent a crack in the metal from developing. The number of separated segments could range from two to twenty segments on a single cymbal. Tone or pitch could also be achieved by variations in the length of the cut between each segment, either from the edge of the bell of the cymbal to the outer edge or partially to the edge. The length of the dividing cut will affect the tone or pitch as well as the given length and width of each segment in relation to the other segments. This method of segmentation could be applied during the initial cymbal manufacturing and/or after initial cymbal manufacturing (e.g., to recognized standard cymbal designs), either with or without a bell or cup.

In one aspect, a cymbal having a metallic structure is provided, the structure having a plurality of radial cuts therein defining a plurality of segments, each of the plurality of segments providing a tone different than another of the plurality of segments.

In one embodiment, a first of the plurality of cuts has a length equal to a length of a second of the plurality of cuts.

In one embodiment, all of the plurality of cuts have a common length.

In one embodiment, a first of the plurality of segments has a width between respective cuts that is equal to a width of a second of the plurality of segments.

In one embodiment, all of the plurality of segments have a common width between respective cuts.

In one embodiment, a first of the plurality of cuts has a length equal to a length of a second of the plurality of cuts, and wherein a first of the plurality of segments has a width between respective cuts that is equal to a width of a second of the plurality of segments.

In one embodiment, a first of the plurality of cuts has a length greater than a length of a second of the plurality of cuts, and wherein a first of the plurality of segments has a width between respective cuts that is greater than a width of a second of the plurality of segments.

In one embodiment, a third of the plurality of cuts has a length equal to a length of a fourth of the plurality of cuts, and wherein a third of the plurality of segments has a width between respective cuts that is equal to a width of a fourth of the plurality of segments.

In one embodiment, a first of the plurality of segments has an edge that is non-continuous with an edge of a second of the plurality of segments.

In one embodiment, a first of the plurality of segments has an edge that is non-continuous with an edge of a second of the plurality of segments and a third of the plurality of segments has an edge that is continuous with a fourth of the plurality of segments.

In one embodiment, a first of the plurality of segments has an edge that is concave and a second of the plurality of segments has an edge that is convex.

In one embodiment, a first of the plurality of segments has an arc shaped edge with a radius that is different than a radius of an arc shaped edge of a second of the plurality of segments.

In one embodiment, a first of the plurality of segments has an edge with a compound curve therein.

In one embodiment, the compound curve includes a concave portion and a convex portion.

In one embodiment, the metallic structure comprises a bronze alloy.

In one embodiment, a first of the segments is made from a first alloy and a second of the plurality of segments is made from a second alloy.

In one embodiment, a first of the segments has a thickness greater than a thickness of a second of the plurality of segments.

In one embodiment, a first of the segments has curvature different from a curvature of a second of the plurality of segments.

In one embodiment, the plurality of cuts extend to an outer perimeter of the cymbal.

In one embodiment, at least one of the plurality of cuts terminates prior to an outer perimeter of the cymbal.

Additional aspects of the present invention will be apparent in view of the description which follows.

DETAILED DESCRIPTION OF THE INVENTION

Figure 1A:
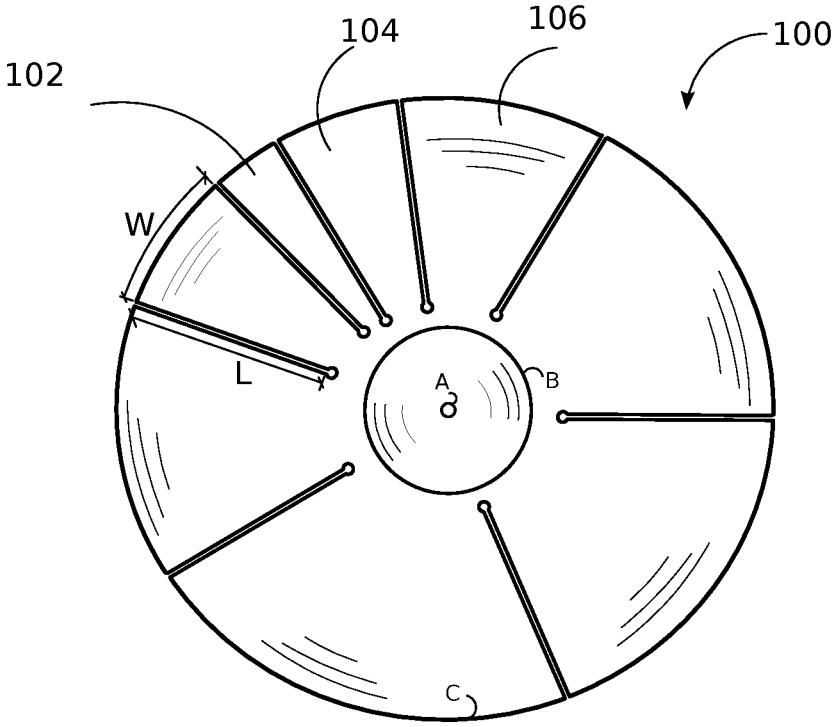
FIG. 1A is a top view of a multi tone cymbal according to a first embodiment of the cymbals disclosed herein.

The present application provides multi tone cymbals. The multi tone cymbals may be derived from a method of segmenting the existing cymbal designs, either during the cymbal manufacturing process, or after the cymbal manufacturing process, by making radial cuts or divisions in the bronze cymbal or disc, in each case, either with or without a bell or cup. Belled cymbals or flat cymbals are standard designs, without segmentations, or radial separations. The method and process of creating cymbal segmentation and varying segment sizes differentiates the multi tone cymbal from existing cymbals.

Variations of pitch or tone in the multi tone cymbal are created either by variation in the width of each segment, the length of each segment, by the length of a given cut between segments or tuning or by the hammering process. This method can be applied to any diameter cymbal. The design concept is not changed by the size, measured by diameter, of the cymbal utilizing the segmentation process. The method for creating a multi tone cymbal is not relegated to a fixed diameter of a given standard cymbal. Given the vast number of pitches or tones possible, the multi tone cymbal concept is not dependent upon a set or given arrangements of pitches (e.g., fixed or accepted musical scales, notes or random pitches, tuned or otherwise). The method allows for any and all possible pitches or tones.

The desired pitches or notes could be achieved by tuning to a chosen note and pitch value by the effect of creating different lengths or widths of the individual segments as well as methods of fine tuning, such as the use of accepted traditional hammering techniques, by hand or machine, to modify the profile shape or tension to additionally raise or lower the pitch of each segment in conjunction with segment size. The technique of hammering a cymbal for altering the sound characteristics is a common method of cymbal production tuning and applies to the manufacturing of the multi tone cymbal as well. Both sizing and hammering of the segments is a necessary process and technique used to create the desired effect on pitch and tone in addition to segmenting the original cymbal form during production of the multi tone cymbal. Hammering the curvature and profile of a segment can raise or lower the inherent segment's pitch to achieve the final desired pitch, thus allowing for control of the note value of each segment by comparison to the next segment depending on the degree of hammering and the profile produced. Thus, two equal sized segments could be tuned to two distinctly different pitches using this method. This hammering method is how the final tone is fine tuned to the desired pitch in conjunction with segment size to create and control pitch values in relation to each other on a single multi tone cymbal. This is achieved by the craftsman during the manufacturing process and is subjective to the will of the craftsman in determining the final pitches to be created. The same applies to the length and width of each segment in determining the desired pitch or note. Since the range of pitches or scales is so vast and varied, all methods of changing the pitch are needed to reach the final desired arrangement of notes.

Figure 1B:
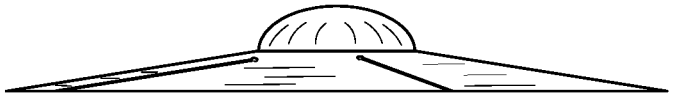
FIG. 1B is a side view of a multi tone cymbal according to the first embodiment of the cymbals disclosed herein.

Referring to FIGS. 1A-1B, the multi tonal cymbal according to a first embodiment is shown with variations in segment width (W), except with equal length radial cuts (L). As can be seen, the cymbal 100 includes a plurality of segments 102, 104, 106, etc. defined by a width (W) measured in degrees or otherwise and length (L). In this embodiment, the cuts defining the segment extend radially from the center A and/or the bell edge (B) of the cymbal and the length L is constant for each of the plurality of the segments. The cymbal 100 may be configured so that no two segments have the same width.

Figure 2:
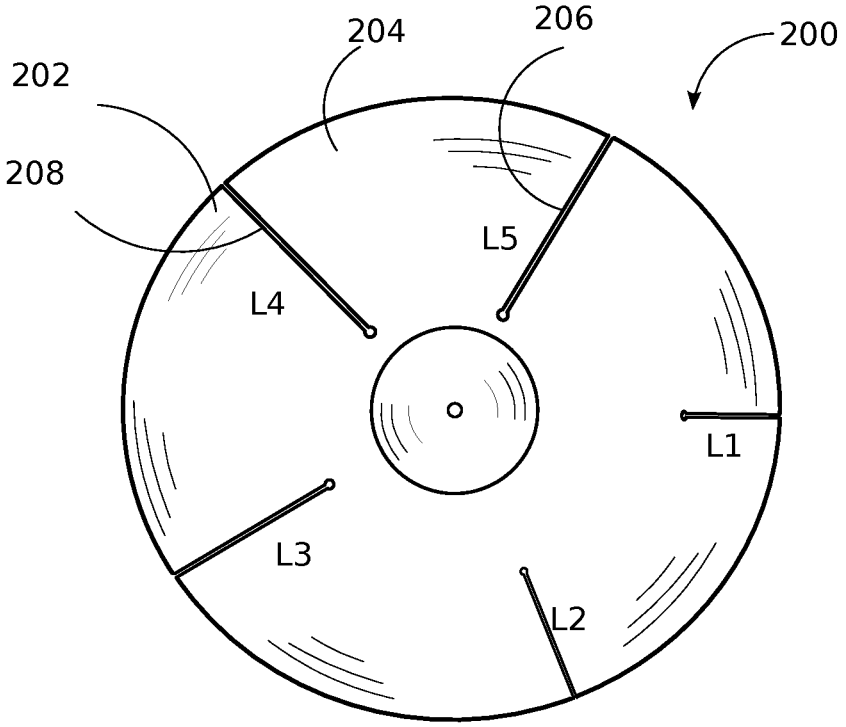
FIG. 2 is a top view of a multi tone cymbal according to at least one other embodiment of the cymbals disclosed herein.

Referring to FIG. 2, an embodiment is shown with the length of the cuts 208, 206 varying, whereas the width of each of the segments remains essentially the same. In this regard, segment 202 and 204 may have the same width whereas the length of the consecutive segments 206, 208 may vary, i.e., one segment is greater than the other. That is, L5>L4>L3>L2>L1. In this regard, the cymbal 200 may be configured so that no two segments have the same length.

Figure 3:
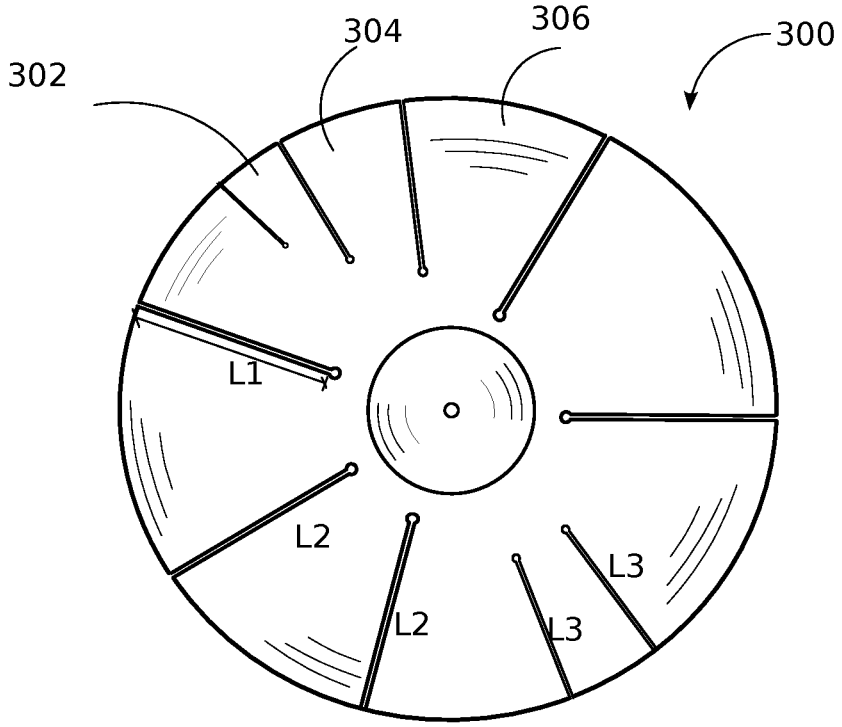
FIG. 3 is a top view of a multi tone cymbal according to at least one other embodiment of the cymbals disclosed herein.

FIG. 3 shows a cymbal 300 according to one embodiment in which both the length and width of the segments vary, preferably so that no two segments have the same length and width. In certain embodiments, some but not all of the lengths and/or widths are equal. For example, L1>L2>L3, but at least two segments have a cut L2 and at least two segments have a cut L3. In certain embodiments, a plurality of segments may have the same dimensions but differ with respect to the forming technique to give a different tone, for example, hammering vs. not hammering, thickness, etc.

FIGS. 1-3 embodiments show circular symbols. In certain embodiments, the cymbals can be non-circular, such as oval, square, rectangular, or any geometric shape. In additional to cymbals with a continuous perimeter, non-continuous shaped cymbals may also be used, such as those shown in FIGS. 4-6.

Figure 4:
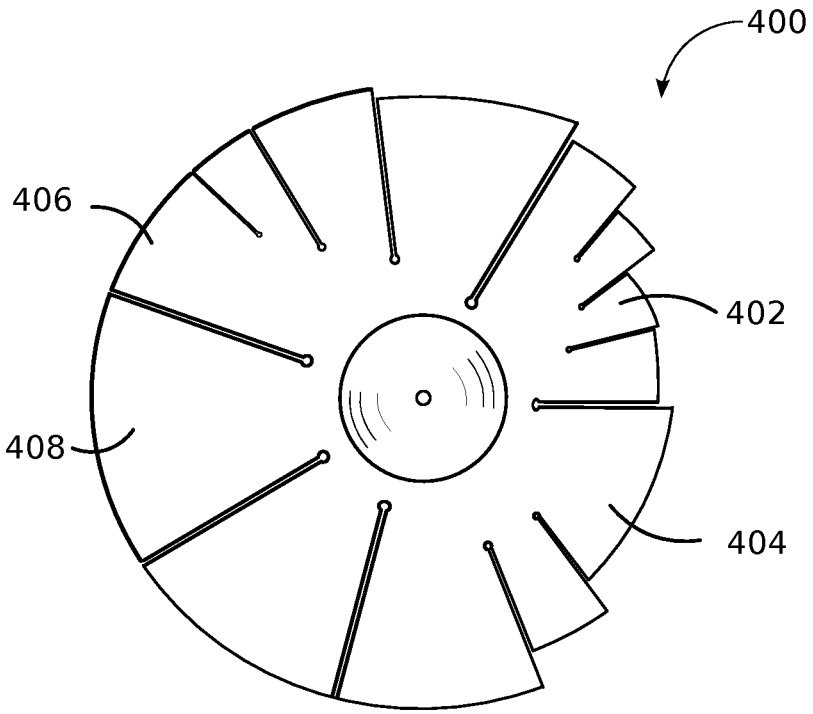
FIG. 4 is a top view of a multi tone cymbal according to at least one other embodiment of the cymbals disclosed herein.
Figure 5:
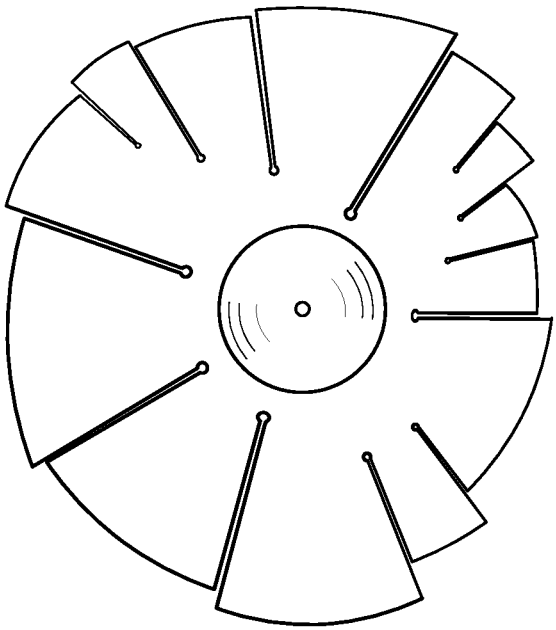
FIG. 5 is a top view of a multi tone cymbal according to at least one other embodiment of the cymbals disclosed herein.
Figure 6:
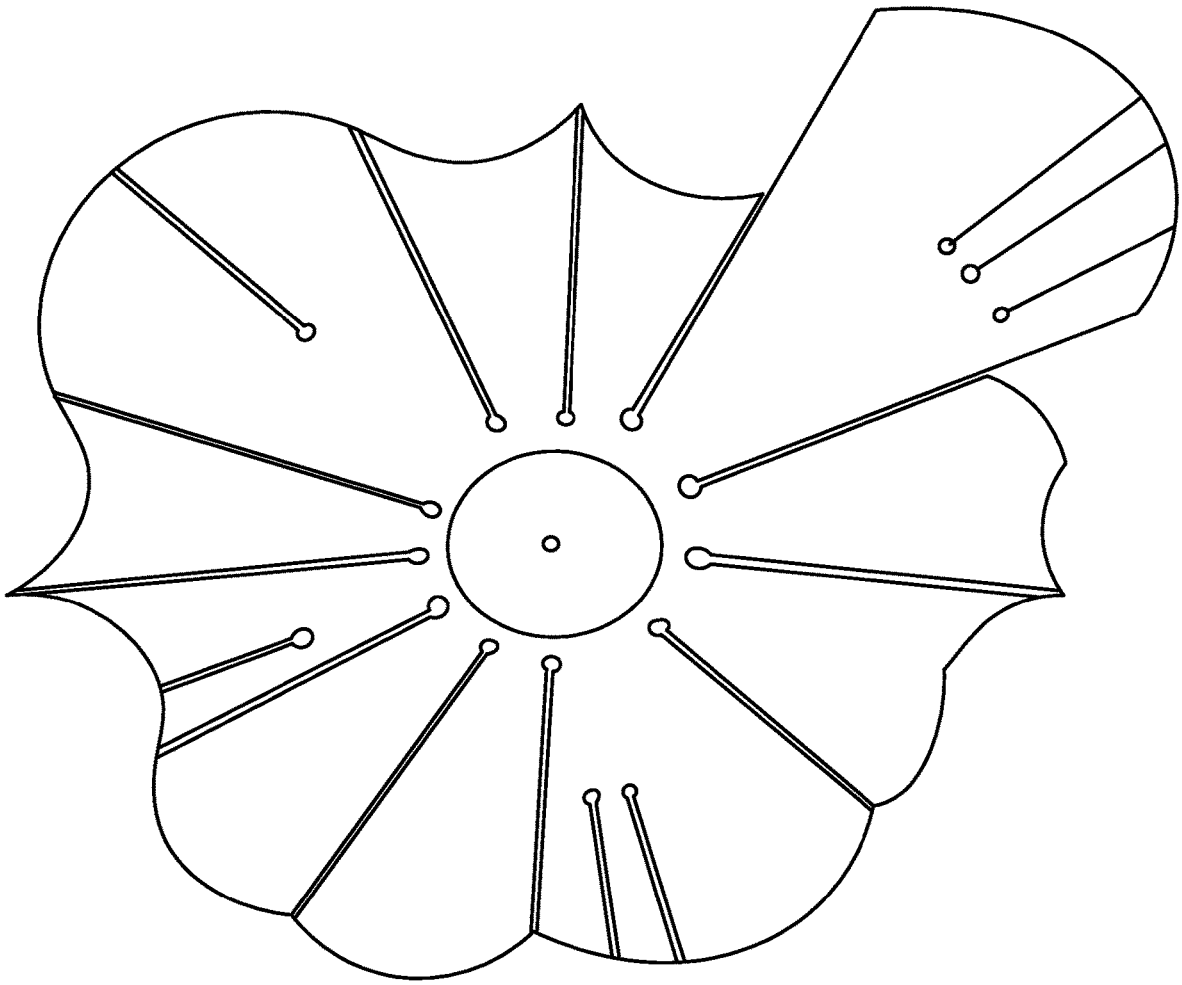
FIG. 6 is a top view of a multi tone cymbal according to at least one other embodiment of the cymbals disclosed herein.
Figure 7:
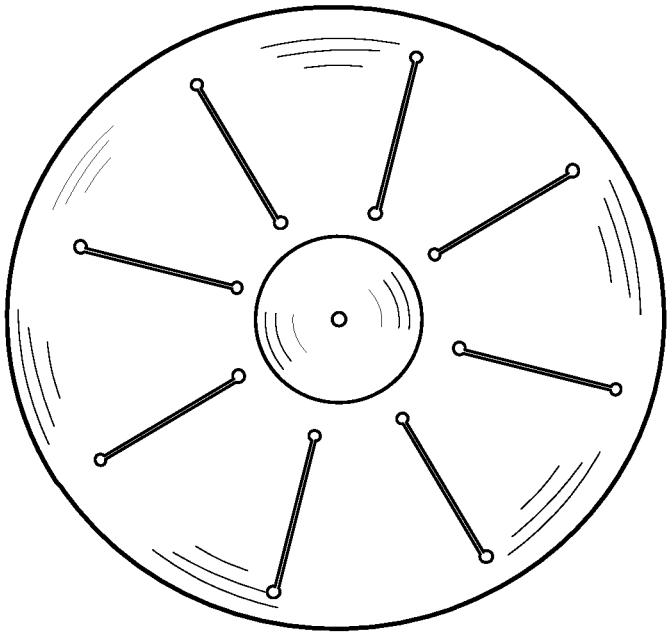
FIG. 7 is a top view of a multi tone cymbal according to at least one other embodiment of the cymbals disclosed herein.

Referring to FIG. 4, the cymbal 400 includes a plurality of non-continuous segments 402, 404, etc., and a plurality of continuous segments 406, 408. As with the other embodiments, the width and length of each of the segments may vary. The embodiment shown in FIG. 5 includes all non-continuous segments. Embodiments 400, 500 have arc shaped edges with essentially the same radius. In FIG. 6, the segments have arc shaped edges with unequal radii. Moreover, the arcs may be convex or concave, or a combination thereof, as shown. Moreover, each of these segments may further be segmented to achieve the desired tone/pitch. The cuts may extend radially to the outer perimeter of the cymbal, as shown in FIGS. 1-6, or may terminate prior to the outer perimeter, as shown in FIG. 7. In this embodiment, the cuts may include holes at the proximal and distal ends as shown.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A cymbal having a metallic structure having a plurality of radial cuts therein defining a plurality of segments, each of the plurality of segments providing a tone different than another of the plurality of segments.

2. The cymbal of claim 1, wherein a first of the plurality of cuts has a length equal to a length of a second of the plurality of cuts.

3. The cymbal of claim 1, wherein all of the plurality of cuts have a common length.

4. The cymbal of claim 1, wherein a first of the plurality of segments has a width between respective cuts that is equal to a width of a second of the plurality of segments.

5. The cymbal of claim 1, wherein all of the plurality of segments have a common width between respective cuts.

6. The cymbal of claim 1, wherein a first of the plurality of cuts has a length equal to a length of a second of the plurality of cuts, and wherein a first of the plurality of segments has a width between respective cuts that is equal to a width of a second of the plurality of segments.

7. The cymbal of claim 1, wherein a first of the plurality of cuts has a length greater than a length of a second of the plurality of cuts, and wherein a first of the plurality of segments has a width between respective cuts that is greater than a width of a second of the plurality of segments.

8. The cymbal of claim 7, wherein a third of the plurality of cuts has a length equal to a length of a fourth of the plurality of cuts, and wherein a third of the plurality of segments has a width between respective cuts that is equal to a width of a fourth of the plurality of segments.

9. The cymbal of claim 1, wherein a first of the plurality of segments has an edge that is non-continuous with an edge of a second of the plurality of segments.

10. The cymbal of claim 1, wherein a first of the plurality of segments has an edge that is non-continuous with an edge of a second of the plurality of segments and a third of the plurality of segments has an edge that is continuous with a fourth of the plurality of segments.

11. The cymbal of claim 1, wherein a first of the plurality of segments has an edge that is concave and a second of the plurality of segments has an edge that is convex.

12. The cymbal of claim 1, wherein a first of the plurality of segments has an arc shaped edge with a radius that is different than a radius of an arc shaped edge of a second of the plurality of segments.

13. The cymbal of claim 1, wherein a first of the plurality of segments has an edge with a compound curve therein.

14. The cymbal of claim 13, wherein the compound curve includes a concave portion and a convex portion.

15. The cymbal of claim 1, wherein the metallic structure comprises a bronze alloy.

16. The cymbal of claim 1, wherein a first of the segments is made from a first alloy and a second of the plurality of segments is made from a second alloy.

17. The cymbal of claim 1, wherein a first of the segments has a thickness greater than a thickness of a second of the plurality of segments.

18. The cymbal of claim 1, wherein a first of the segments has curvature different from a curvature of a second of the plurality of segments.

19. The cymbal of claim 1, wherein the plurality of cuts extend to an outer perimeter of the cymbal.

20. The cymbal of claim 1, wherein at least one of the plurality of cuts terminates prior to an outer perimeter of the cymbal.

* * * * *